US005618623A

United States Patent [19]

Nakajima et al.

[11] Patent Number: 5,618,623

[45] Date of Patent: Apr. 8, 1997

[54] FLAME-RETARDANT FIBER AND NONWOVEN FABRIC

[75] Inventors: Yuji Nakajima; Masahiko Taniguchi, both of Moriyama, Japan

[73] Assignee: Chisso Corporation, Osaka, Japan

[21] Appl. No.: 681,405

[22] Filed: Jul. 23, 1996

Related U.S. Application Data

[62] Division of Ser. No. 496,226, Jun. 28, 1995, Pat. No. 5,567,517.

[30] Foreign Application Priority Data

Jul. 8, 1994 [JP] Japan ..... 6-180633

[51] Int. Cl.[6] ..... D02G 3/00

[52] U.S. Cl. ..... 428/364; 428/372; 428/373; 428/375; 428/394; 428/920; 428/921; 442/302; 442/414

[58] Field of Search ..... 428/364, 372, 428/375, 373, 394, 224, 245, 288, 920, 921

[56] References Cited

U.S. PATENT DOCUMENTS 5,324,874 6/1994 Ransford et al. ..... 570/208

5,457,248 10/1995 Mack et al. ..... 570/208

*Primary Examiner*—Patrick Ryan
*Assistant Examiner*—J. M. Gray
*Attorney, Agent, or Firm*—Oblon, Spivak, McClelland, Maier & Neustadt, P.C.

[57] ABSTRACT

The invention provides a thermoplastic resin fiber which forms no dioxin-related compound when oxidized or burned, and is excellent in flame retardancy even when the content of a flame retardant is low. This flame-retardant fiber contains 5 to 15% by weight of a flame retardant having the following general formula (1):

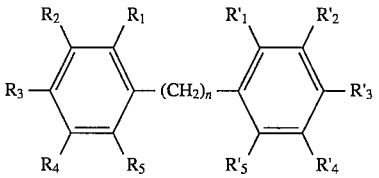

(1)

where R1 to R5 and R'1 to R'5 are independently Br or Cl with the Br/Cl ratio lying in the range of 100/0 to 40/60, and n is an integer of 2 to 16, and 2 to 8% by weight of antimony oxide as a flame retardant promoter.

8 Claims, No Drawings

FLAME-RETARDANT FIBER AND NONWOVEN FABRIC

This is a Division, of application Ser. No. 08/496,226 filed on Jun. 28, 1995, now U.S. Pat. No. 5,567,517.

BACKGROUND OF THE INVENTION

1. Field of the Invention

The present invention relates generally to flame-retardant fibers and nonwoven fabrics formed of such fibers, and more particularly to flame-retardant fibers which form no dioxin-related compounds when burned, and nonwoven fabrics, woven fabrics and formed products made up of such fibers.

2. Prior Art

Synthetic fibers such as those formed of nylon, polyester, polypropylene and the like, because of being excellent in physical and chemical properties, find now wide applications in the form of clothing, curtain, carpet and other materials. However, these fibers are combustible; so they are required to have flame retardancy when applied to automotive trims, housing, etc.

Imparting flame retardancy to fibers is generally achieved by adding flame retardants to the starting polymers or post-treating fibers with flame retardants.

A typical example of a polymer with a flame-retardant added thereto is a polyolefinic composite fiber mixed with a fine particle form of flame-retardant which has a decomposition temperature higher than its spinning temperature by at least 100° C., as disclosed in Japanese Patent Laid-Open No. 58(1983)-156019.

Another typical composite fiber based on polyester is disclosed in Japanese Patent Laid-Open No. 54(1979)-134120, which comprises a polyester component containing phosphorus and/or a halogen and a fiber-forming polyester component.

Among known flame retardants that may be added to the starting polymer, there is decabromodiphenyl oxide that has the merit of imparting sufficient flame retardancy to the polymer in a small amount, so that the resultant fiber can be best made of the property of the polymer of its own, but has the demerit of forming dioxin-related compounds when burned. Since the dioxin-related compounds are known to be of carcinogenicity, it is expected that the use of decabromodiphenyl oxide will be banned in the near future.

Other flame retardants (for instance, tricresyl phosphate, ammonium phosphate and aluminum hydroxide) having such a structure that inhibits the formation of dioxin-related substances must be added to the starting polymer at an increased concentration to impart sufficient flame retardancy to the polymer. Thus these agents have the disadvantage of making the physical properties of the polymer fiber worse unless added thereto in a sufficient amount, and so incurring some considerable expense.

For the post-treatment of fibers with a flame retardant, the flame retardant diluted with water or an organic solvent is deposited to the fibers or fabrics by impregnation or spraying. For instance, Japanese Patent Laid-Open No. 48(1973)-13696 discloses a thermoplastic resin fiber sprayed with an organic halogen type of flame retardant containing phosphorus. With such a method, it is relatively easy to make fibers or fabrics flame-retardant. However, a problem with this method is that the flame retardant detaches itself off the surfaces of the fibers in a powder form or becomes readily disengaged from the fibers by washing.

An object of the present invention is therefore to achieve provision at low costs of high-quality fibers which form no dioxin-related compound even when burned and maintains the required flame retardancy even when the amount of the flame retardant used is small.

SUMMARY OF THE INVENTION

As a result of intensive and extensive studies made so as to achieve the object mentioned above, it has now been found that by use of the flame retardant mentioned below it is possible to obtain the desired flame-retardant fibers.

One aspect of the present invention is directed to a flame-retardant fiber containing 5 to 15% by weight of a compound having the following general formula (1) as a flame retardant and 2 to 8% by weight of antimony oxide as a flame retardant promoter on the basis of the total weight of the fiber:

Formula (1)

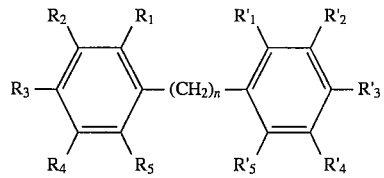

(1)

where R1 to R5 and R'1 to R'5 are independently Br or Cl with the Br/Cl ratio lying in the range of 100/0 to 40/60, and n is an integer of 2 to 16.

The first aspect of the present invention will now be explained in detail.

For the thermoplastic resin used for the flame-retardant fiber according to the present invention, mention is made by way of example of α-olefin homopolymers such as polypropylene, polyethylene, polybutene-1 and poly-4-methylpentene-1, bipolymers or terpolymers of propylene and other α-olefins, polyethylene terephthalate, and ethylene-vinyl acetate copolymers, among which, in view of the ability to be spun and receive a card therethrough, etc., it is preferable to use a polyolefin resin that has a melting point of about 115° C. or higher and is crystalline as well.

The compound having the above-mentioned formula (1) used as the flame retardant in the present invention has a melting point of about 345° C. and a decomposition temperature of about 360° C. This compound, because of having no ether bond in its molecule, forms no dioxin-related compound when burned. Moreover, the compound, because of being higher than known flame-retardants in terms of the content of bromine, can impart higher flame-retardant performance to fibers in a reduced amount. In formula (1) it is desired that n=2 to 16, preferably n=2 to 5, because a compound with n=1 is structurally unstable. In this compound the Br/Cl ratio lies preferably in the range of 100/0 to 70/30, because it is less effective for achieving flame retardancy at less than 40/60.

In the present invention, the flame retardant is added to a fiber in an amount of 5 to 15% by weight on the basis of the total weight of the fiber. Note that the upper limit of the amount of the flame retardant added to a fiber varies depending on fineness of the fiber. It is preferable that the flame retardant is used in an amount of about 5.0 to 8% by weight for a fiber having a fineness of about 1 to 20 d/f, in an amount of about 5.0 to 12% by weight for a fiber having a fineness of about 21 to 100 d/f, and in an amount of 5 to 15% by weight for a fiber having a fineness of about 100 to 5,000 d/f.

The flame retardant promoter is antimony trioxide or pentaoxide, which is added to a fiber in an amount of 2 to 8% by weight on the basis of the total weight of the fiber or, usually, in an amount about half that of the flame retardant.

The thermoplastic resin with the flame retardant and flame retardant promoter added to it may be formed into fibers by known melt spinning techniques, and may thereafter be stretched and crimped. Such melt spinning techniques, for instance, include single or composite spinning, spun bonding, and melt blowing. No particular limitation is placed on the fineness of flame-retardant fibers; that is, they may have a fineness preselected depending on what purpose they are used for, for instance, a fineness of about 0.5 to 1,000 d/f in the form of staples or multifilaments, and a fineness of about 50 to 5,000 d/f in the form of monofilaments.

The flame-retardant fibers of the present invention may be in the form of composite fibers such as sheath-core, side-by-side, islands-in-sea and multi-divided type fibers. A sheath-core type fiber may contain equal or varying amounts of the flame retardant and flame retardant promoter in both the sheath and core components. In addition, either one of the sheath and core components may contain known modifiers such as matting agents, antistatic agents, electrically conductive agents, pigments or other polymers.

Another aspect of the present invention is directed to a flame-retardant fiber obtained by adding to the flame-retardant fiber according to the first aspect mentioned above 0.02 to 1% by weight of a surface treating agent comprising an alkyl phosphate salt with the alkyl group having 12 to 18 carbon atoms. Such an alkyl phosphate salt is exemplified by potassium lauryl phosphate, potassium myristyl phosphate, potassium cetyl phosphate and potassium stearyl phosphate or its sodium salts. A fiber with this surface treating agent deposited to it is excellent in resistance to discoloration by a gas. The surface treating agent, when deposited to the fiber in an amount of less than 0.01% by weight, introduces no sufficient improvement in resistance to discoloration by a gas, and when deposited to the fiber in an amount of more than 1% by weight, causes the fiber to have adhesiveness; in other words, any departure from the range of 0.02% to 1% by weight is not preferable.

Still another aspect of the present invention is directed to a flame-retardant fiber obtained by using a polyolefin as the starting polymer, a nonwoven fabric formed of such flame-retardant fibers, a woven fabric formed of such flame-retardant fibers, and a product formed of such flame-retardant fibers.

The present invention will now be explained in practical with reference to some preferable examples. Notice that the physical and other properties referred to therein were measured as follows:

Flame Retardancy

A test piece of 2.5 cm×30 cm is cut out of a nonwoven fabric having a basis weight of 300 g/m$^2$, fixed at an angle of 30°, and ignited at the lower end with a match flame for 10 seconds. After the completion of ignition, how long the test piece continues to burn is measured. A test piece with the burning time of 6 second or shorter is taken as having acceptable flame retardancy. If the sample gain more than 80% of tests taken as having acceptable flame retardancy after 20 cycles of burning test, it is then deemed as being acceptable.

Discoloration by Gas

A test piece of 40 cm×40 cm is cut out of a needle-punched nonwoven fabric having a weight of 300 g/m$^2$, and is hung down from the eaves of a warehouse along a road with a heavy traffic. After the lapse of 150 days, how the nonwoven fabric sample have discolored is measured on a gray scale for contamination according to JIS-L0805 with grades 1 to 5 representing heavy to light contamination, respectively.

Presence or Absence of Dioxin-Related Compounds

Using a gas chromatography having a mass spectrometer connected to it, whether or not dioxin and related compounds are present in the combustion gas generated during the flame retardancy testing is detected.

EXAMPLES 1–3

Decabromodiphenylethane and antimony trioxide were added to polypropylene powders having a melt flow rate of 21 as measured at 230° C. for 10 minutes and having a melting point of 163° C. at the weight ratios shown in Table 1, as the resultant compounds being 100% by weight in total. The compounds were then pelletized with a single screw extruder.

Each of the obtained pellets was subjected to melt spinning at a temperature of 260° C. through a spinneret having 60 spinning openings of 1.5 mm in diameter to obtain a fiber of 54 d/f. This spun fiber was stretched at a temperature of 90° C. and a stretch ratio of 3.0, provided with 12 crimps per 25 mm by a cripmer, and cut by a cutter to obtain a staple having a single yarn fineness of 18.0 d/f and a fiber length of 64 mm. In Examples 1 and 2, 0.3% by weight of potassium lauryl phosphate as a surface treating agent was deposited to each staple whereas, in Example 3, 0.01% by weight of potassium lauryl phosphate as a surface treating agent was deposited to the staple.

Each staple was carded with a carding machine into a carded web, which was in turn subjected to needle punching to obtain a carpet having a weight of 300 g/m$^2$. This carpet was measured for flame retardancy, discoloration by gas and whether or not dioxin-related compounds are present in the combustion gas. The results are reported in Table 1.

EXAMPLE 4

The same flame retardant and flame retardant promoter as in Example 1 were added to high-density polyethylene powders having a melt flow rate of 22 as measured at 190° C. for 10 minutes and a melting point of 134° C. in the same amounts as in Example 1, and pelletized to obtain the first component for a composite fiber. Here the second component was polypropylene with the flame retardant used in Example 2 added to it.

Using a sheath-core type of composite spinneret having 100 spinning openings of 0.8 mm in diameter, the above-mentioned first and second components were subjected to melt spinning at a composite weight ratio of 1:1 and an identical spinning temperature of 260° C. while the first and second components were located on the sheath and core sides, respectively, thereby obtaining a sheath-core type of composite fiber yarn having a fineness of 18 d/f. Deposited to this yarn was 0.3% by weight of potassium lauryl phosphate as a surface treating agent. This spun yarn was stretched at a temperature of 90° C. and a stretch ratio of 3, provided with 14 crimps per 25 mm by a crimper, and cut by a cutter to a flame-retardant staple having a single fiber fineness of 6.0 d/f and a fiber length of 64 mm. This staple was carded with a carding machine into a carded web, which was in turn subjected to needle punching to obtain a carpet having a weight of 300 g/m$^2$. The thus obtained carpet was then thermally treated at 145° C. for 4 minutes with a hot-air dryer to obtain a finished carpet with the fibers thermally fused together at their points of intersection. This carpet was found to have 80% or more of tests showing acceptable flame retardancy, and have grade 4 in terms of resistance to discoloration by gas as well.

This finished carpet could be laid on the floor of a car or house with or without polyethylene or foamed polyurethane laminated on its back side. This carpet was also compression-molded after heating, so that it could be well fit to the contour of a vehicle.

The fiber according to Comparative Example 3 is poor in flame retardancy, and so must contain much flame retardant so as to achieve sufficient flame retardancy, and is inferior in resistance to discoloration by gas as well. This fiber was deposited thereon with 0.30% by weight of the surface treating agent as in Example 1, but was tinged with pink in discoloration by gas testing. This is believed to be due to the interaction of the added flame retardant with the surface treating agent.

TABLE 1

| No. | Type of flame retardant | Flame retardant in % by weight | Flame retardant promoter in % by weight | Proportion of acceptable fibers in % | Discoloration by gas, graded 1 to 5 | Presence/ absence of dioxin-related compounds | Estimation |
|---|---|---|---|---|---|---|---|
| Example 1 | ① | 5.0 | 2.5 | 80 | 5.0 | not found | ○ |
| Example 2 | ① | 10.0 | 5.0 | 100 | 5.0 | not found | ○ |
| Example 3 | ① | 5.0 | 2.5 | 80 | 2.0 | not found | ○ |
| Example 4 | ① | 5.0 | 2.5 | 80 | 4.0 | not found | ○ |
| Comparative Example 1 | ② | 20.0 | 10.0 | 30 | 5.0 | not found | X |
| Comparative Example 2 | ③ | 5.0 | 2.5 | 100 | 5.0 | found | X |
| Comparative Example 3 | ④ | 20.0 | 0 | 60 | 1.0 | not found | X |

①: Decabromodiphenylethane

②: Ethylenebistetrabromophthalimide

③: Decabromodiphenyl oxide

④: Ammonium polyphosphate/triazine derivative

The performance, etc., of these carpets are shown in Table 1. The products obtained in Examples 1 and 2 were found acceptable to have enough flame retardancy with no generation of dioxin. The products with 0.3% by weight of the surface treating agent deposited on them were found acceptable to have enough resistance to discoloration by gas (Examples 1 and 2).

However, the product with 0.01% by weight of the surface treating agent deposited to it was somewhat inferior in resistance to discoloration by a gas, although it had acceptable flame retardancy and did not give out dioxin.

COMPARATIVE EXAMPLES 1 to 3

Polypropylene compounds were obtained following Example 1 with the exception that ethylenebistetrabromophthalimide (Comparative Example 1), decabromodiphenyl oxide (Comparative Example 2), and ammonium polyphosphate and a triazine derivative (Comparative Example 3) were used as the flame retardants.

As in Example 1, these compounds were subjected to melt spinning, deposition of the surface treating agent, needle punching and other processing to obtain carpets, which were measured for physical properties. The results of estimation are shown in Table 1.

The fibers according to Comparative Examples 1 and 2 have acceptable flame retardancy and resistance to discoloration by gas, but are found to produce dioxin when burned.

From Table 1 it turns out that the flame-retardant fibers according to the present invention are excellent in flame retardancy and do not give out dioxin-related compounds when burned. The deposition of the surface treating agent introduces additional improvements in resistance to discoloration by gas.

Therefore, the flame-retardant fibers of the present invention can be subjected to needle punching, tufting, weaving and other processing; so they can provide safe automotive trim materials, and carpet, curtain and other materials for houses and buildings.

What is claimed is:

1. A flame-retardant fiber in which 0.02 to 1% by weight of the fiber of a surface treating agent comprising an alkyl phosphate salt with the alkyl moiety having 12 to 18 carbon atoms is deposited to the surface of said fiber, wherein said fiber comprises a mixture of a thermoplastic resin and 5 to 15% by weight of the fiber of a flame retardant having the following general formula (1):

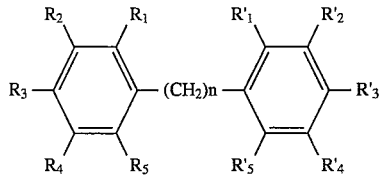

(1)

where R1 to R5 and R'1 to R'5 are independently Br or Cl with the Br/Cl ratio lying in the range of 100/0 to 40/60, and n is an integer of 2 to 16, and 2 to 8% by weight of the fiber of antimony oxide as a flame retardant promoter, said fiber obtained by mixing said resin, flame retardant and flame retardant promoter, to form a mixture, and then forming said mixture into a fiber.

2. The flame-retardant fiber according to claim 1, wherein the fiber comprises a polyolefin fiber.

3. A nonwoven fabric made of the flame-retardant fiber according to claim 2.

4. A woven fabric made of the flame-retardant fiber according to claim 2.

5. A molded product made of the flame-retardant fiber according to claim 2.

6. A nonwoven fabric made of the flame-retardant fiber according to claim 1.

7. A woven fabric made of the flame-retardant fiber according to claim 1.

8. A molded product made of the flame-retardant fiber according to claim 1.

* * * * *